US008061092B2

(12) United States Patent
McClure

(10) Patent No.: US 8,061,092 B2
(45) Date of Patent: Nov. 22, 2011

(54) SAFETY REINFORCED LIGHT TRANSMITTING PANEL ASSEMBLY

(75) Inventor: Richard McClure, Basehor, KS (US)

(73) Assignee: BlueScope Buildings North America, Inc., Kansas City, MO (US)

( * ) Notice: Subject to any disclaimer, the term of this patent is extended or adjusted under 35 U.S.C. 154(b) by 580 days.

(21) Appl. No.: 11/577,168

(22) PCT Filed: Jul. 7, 2006

(86) PCT No.: PCT/US2006/026628

§ 371 (c)(1),
(2), (4) Date: May 4, 2007

(87) PCT Pub. No.: WO2007/011561

PCT Pub. Date: Jan. 25, 2007

(65) Prior Publication Data

US 2009/0223148 A1 Sep. 10, 2009

Related U.S. Application Data

(60) Provisional application No. 60/699,391, filed on Jul. 15, 2005.

(51) Int. Cl.
*E04B 7/18* (2006.01)

(52) U.S. Cl. ..... 52/200; 52/203; 52/630; 52/783.14; 49/50

(58) Field of Classification Search ..... 52/783.14, 52/783.11, 203, 202, 98, 100, 200, 506.06, 52/230; 49/50, 57

See application file for complete search history.

(56) References Cited

U.S. PATENT DOCUMENTS

| | | | | |
|---|---|---|---|---|
| 1,236,008 | A | | 8/1917 | Rysdon |
| 2,959,511 | A | | 11/1960 | Finger |
| 3,521,414 | A | | 7/1970 | Malissa |
| 4,080,763 | A | | 3/1978 | Naidus et al. |
| 4,471,584 | A | | 9/1984 | Dietrich |
| 4,637,444 | A | | 1/1987 | Tanner |
| 4,680,905 | A | | 7/1987 | Rockar |
| 4,860,511 | A | * | 8/1989 | Weisner et al. ..... 52/200 |
| 5,237,788 | A | | 8/1993 | Sandow |
| 5,406,764 | A | * | 4/1995 | Van Auken et al. ..... 52/408 |
| 5,419,090 | A | * | 5/1995 | Sandow ..... 52/200 |
| 5,675,940 | A | | 10/1997 | Bahar et al. |
| 5,682,713 | A | | 11/1997 | Weiss |
| 5,763,045 | A | | 6/1998 | Menzel |
| 5,787,642 | A | | 8/1998 | Coyle et al. |
| 6,199,330 | B1 | | 3/2001 | Cobb |
| 6,209,271 | B1 | | 4/2001 | Kovacs |
| 6,775,951 | B2 | | 8/2004 | Gumpert et al. |
| 7,043,882 | B2 | | 5/2006 | Gumpert et al. |
| 7,134,254 | B1 | | 11/2006 | Van Gelder |
| 2004/0088928 | A1 | | 5/2004 | Headrick et al. |

OTHER PUBLICATIONS

Written Opinion dated Sep. 6, 2007, issued in related PCT Patent Application Serial No. PCT/US06/26628.

(Continued)

*Primary Examiner* — William Gilbert
(74) *Attorney, Agent, or Firm* — Lathrop & Gage LLP

(57) ABSTRACT

A light-transmitting roof panel assembly, having the same shape as adjoining metal roof panels in a standing seam metal roof, includes an outer transparent panel made of a polymeric material and an inner reinforcing panel made of perforated metal. The inner and outer panels nest together and lie flush with the roof. Crimpable side corrugation pieces are attached to the reinforcing panel so that the assembly can be connected to neighboring roof panels by seaming.

11 Claims, 4 Drawing Sheets

OTHER PUBLICATIONS

International Search Report and Written Opinion issued in related PCT/US06/26628, dated Jan. 19, 2007, 5 pages.

International Preliminary Patentability Report issued in related PCT/US06/26628, dated Sep. 7, 2007, 5 pages.

* cited by examiner

Fig. 4
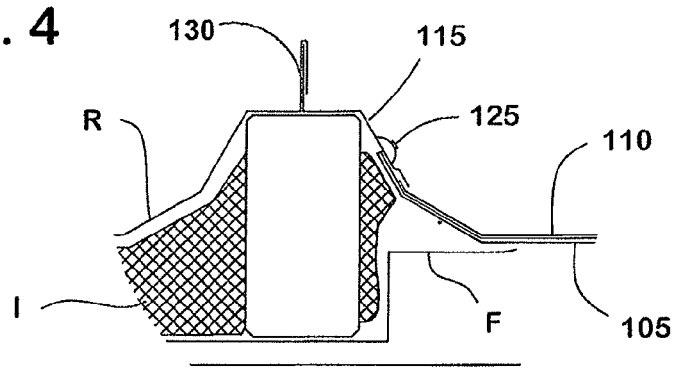
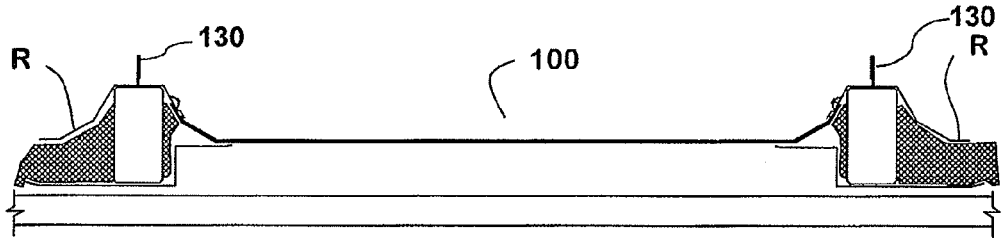
Fig. 3
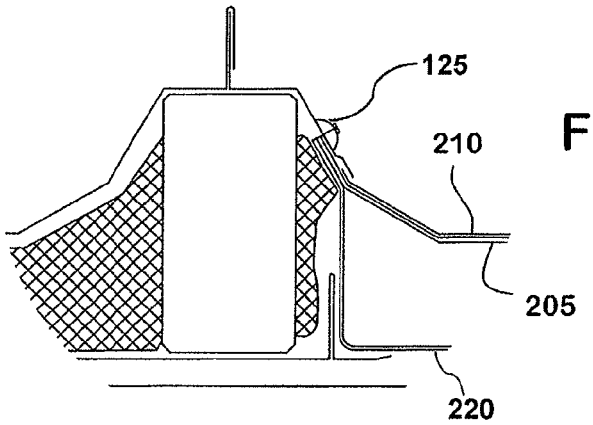
Fig. 6
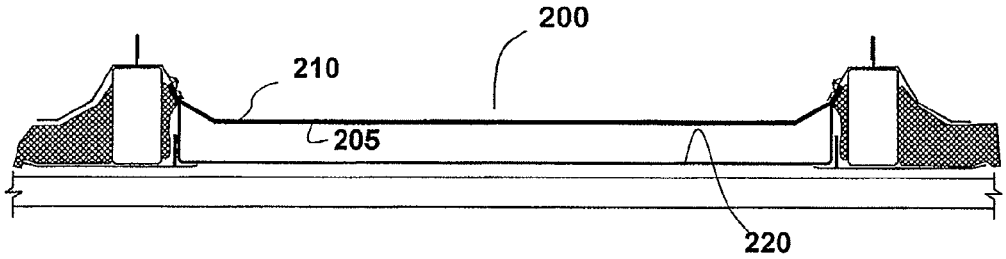
Fig. 5

Fig. 8
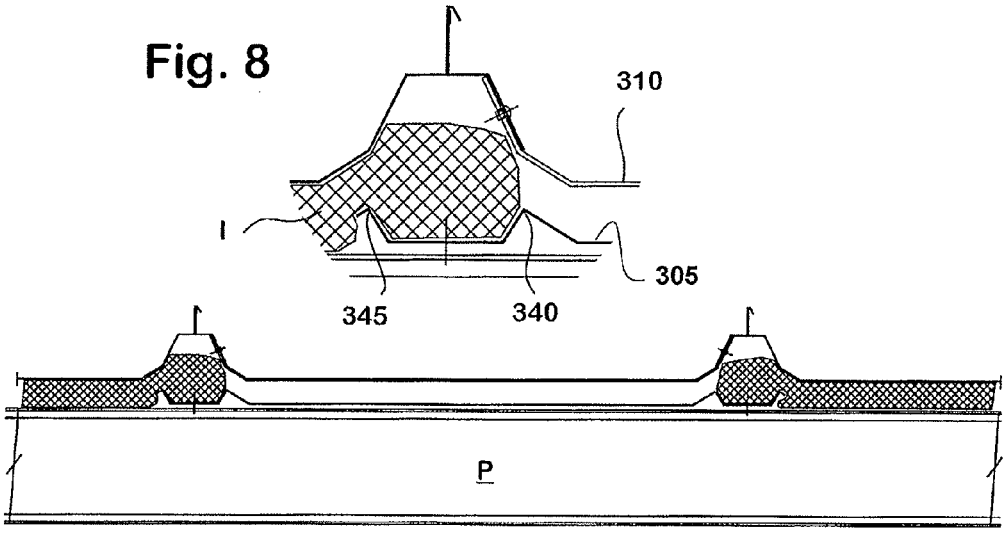
Fig. 7
Fig. 10
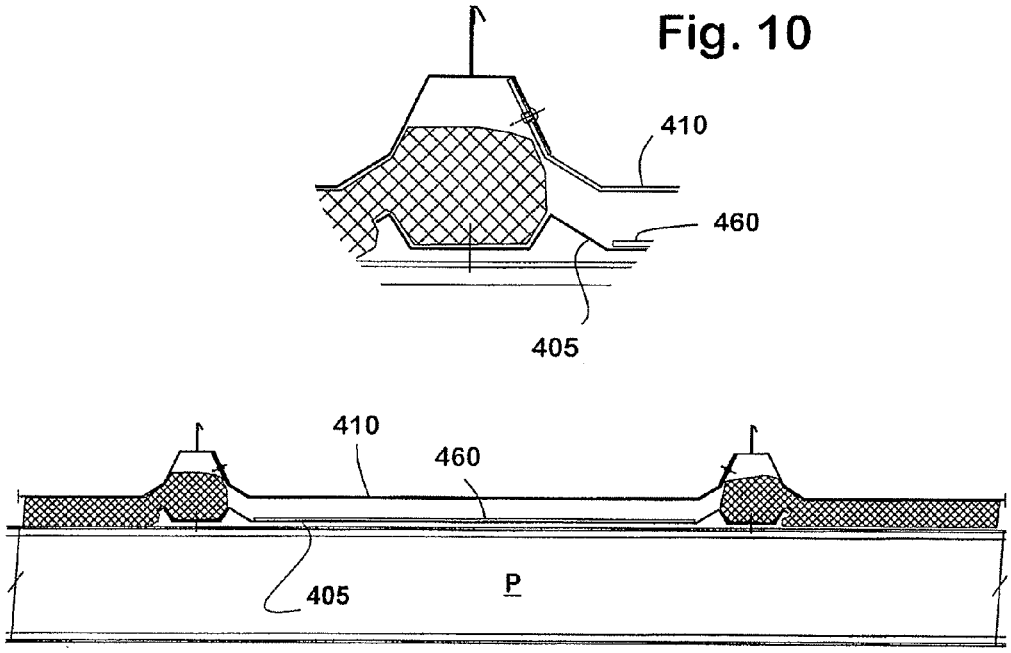
Fig. 9

SAFETY REINFORCED LIGHT TRANSMITTING PANEL ASSEMBLY

This application claims benefit of U.S. Provisional Application No. 60/699,391, filed Jul. 15, 2005.

BACKGROUND OF THE INVENTION

Industrial buildings often have skylights to provide natural lighting and to conserve energy. For buildings with metal roof systems, skylights or "light panels" may be provided in the roof system. The light panels typically have a clear or translucent sheet material formed into a shape similar to the shape of the structural metal panels of the roof, and metal sides for seaming into a standing seam type metal roof system. The light panels are lapped and sealed to the metal roof panels to provide weather-tight joints. An example of such a panel is shown in FIG. 1.

Because metal roofs typically are insulated underneath with blanket or rigid board insulation, sometimes insulation trim-flashing also is provided to terminate the insulation around the light panel opening. This allows sunlight to come into the building through the light panel.

Current light panels for metal roofing offer no permanent fall protection for people who walk on them. Usually, the light-weight, clear/translucent material of the light panels is, when new, strong enough to support the weight of a typical person and/or light equipment, or the impact from falls or dropped objects. However, as the material ages, it weakens and may lose the ability to support the design weights and impacts. Additionally, years of dirt and or debris may cover the light panel and make it hard for people on the roof to distinguish the light panels from adjacent metal roof panels, thereby increasing the risk of the light panel being stepped on. And in case of fire, the material may melt or weaken, posing a risk to a roof-borne firefighters.

Building authorities have attempted to resolve these safety issues by requiring that new building roofs have skylights installed on a roof curb, thereby elevating the light panel above the plane of the roof, and/or that security bar systems (FIG. 2) be installed over the light panel.

Both of these approaches make it easier to know where the light panels are on a roof, and both deter people from walking or standing on them. However, the additional material and labor required to implement these safety features on each of the many light panels of a large building are great.

Complicating the growing need for safer skylights that have inherent structural strength to avoid personnel or equipment fall-throughs, building codes are increasing the amount of roof area that is permitted or required to transmit light.

Thus, what is needed is a roof panel that maximizes light transmission while providing a sufficiently strong structure over the years, even in case of fire, to prevent people or equipment from falling through it.

SUMMARY OF THE INVENTION

To provide a light panel with sufficient strength, the invention provides a light-transmitting metal reinforcing panel beneath a non-metallic light-transmitting panel. The metallic panel is perforated so that it transmits light, and, throughout a wide temperature range, supports prescribed loads and withstands prescribed impacts. The non-metallic panel is preferably made of a transparent polymer.

In one embodiment of the invention, the metal reinforcing panel is shaped to nest closely with the non-metallic panel. In another embodiment, the panels are separated a substantial distance.

Yet another embodiment of the invention includes a first light-transmitting panel configured to mount on a roof and a second light-transmitting panel configured to provide insulation trim flashing, below the first panel.

Other features and advantages of the invention will become apparent from the following description of the preferred embodiment, which refers to the accompanying drawings.

BRIEF DESCRIPTION OF THE DRAWINGS

The invention is described in detail below with reference to the following figures, throughout which similar reference characters denote corresponding features consistently, wherein:

FIG. 3 is a cross-sectional view of a first embodiment of the invention, taken on a plane perpendicular to the length of the panel;

FIG. 4 is an enlargement of a portion of FIG. 3;

FIG. 5 is a cross-sectional view of a second embodiment of the invention;

FIG. 6 is a enlargement of a portion of FIG. 5;

FIG. 7 is a cross-sectional view of a third embodiment of the invention;

FIG. 8 is an enlargement of a portion of FIG. 7;

FIG. 9 is a cross-sectional view of a fourth embodiment of the invention;

FIG. 10 is an enlargement of a portion of FIG. 9;

DETAILED DESCRIPTION OF THE PREFERRED EMBODIMENTS

Figure 1:
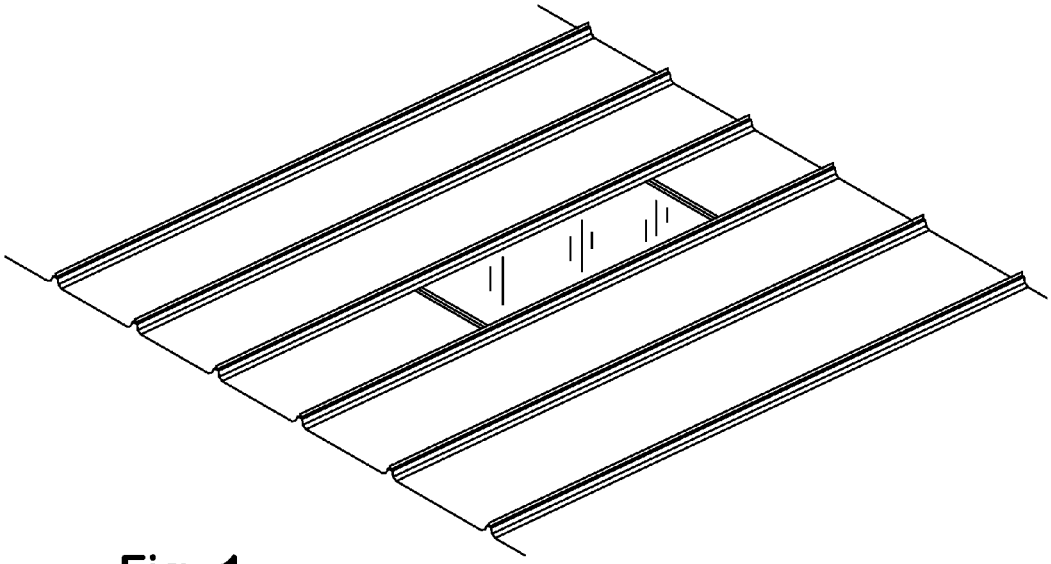
Fig. 1 (PRIOR ART)
FIG. 1 is a perspective view of a conventional flush skylight in a roof.
Figure 2:
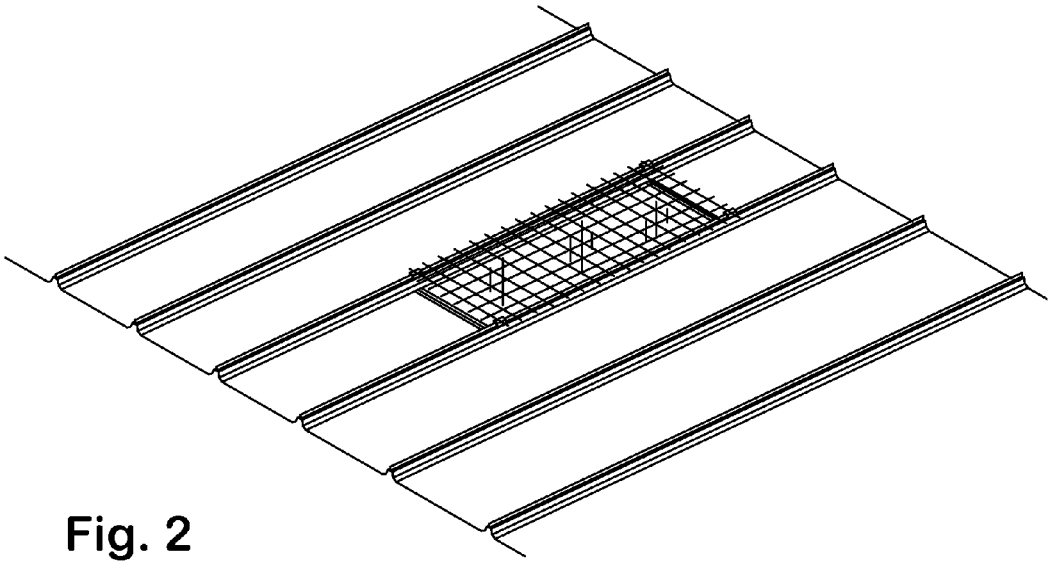
Fig. 2 (PRIOR ART)
FIG. 2 is a perspective view of a conventional heavy wire grid disposed over a skylight.

Referring to FIG. 3, a safety reinforced light transmitting panel assembly 100 embodying the invention includes a reinforcing panel 105 (see detail in FIG. 4) nested below a similarly shaped light-transmitting panel 110. A side corrugation 115 is connected by fasteners such as rivets 125 to both the reinforcing panel and the light-transmitting panel. The side corrugation 115 is used to connect the assembly to adjoining roof panels R during installation.

The reinforcing panel is, preferably, constructed of a strong, light gauge perforated metal and is shaped to nest with the light-transmitting panel. The reinforcing panel is intended to support the weight of a person if the light-transmitting panel breaks or melts during a fire. The alloy, dimensions and the gauge of the metal are chosen so that, throughout a wide prescribed temperature range, the reinforcing panel will have strength sufficient to withstand the weight of people stepping on the assembly, and reasonably anticipated impacts from people or equipment falling on it.

Figure 11:
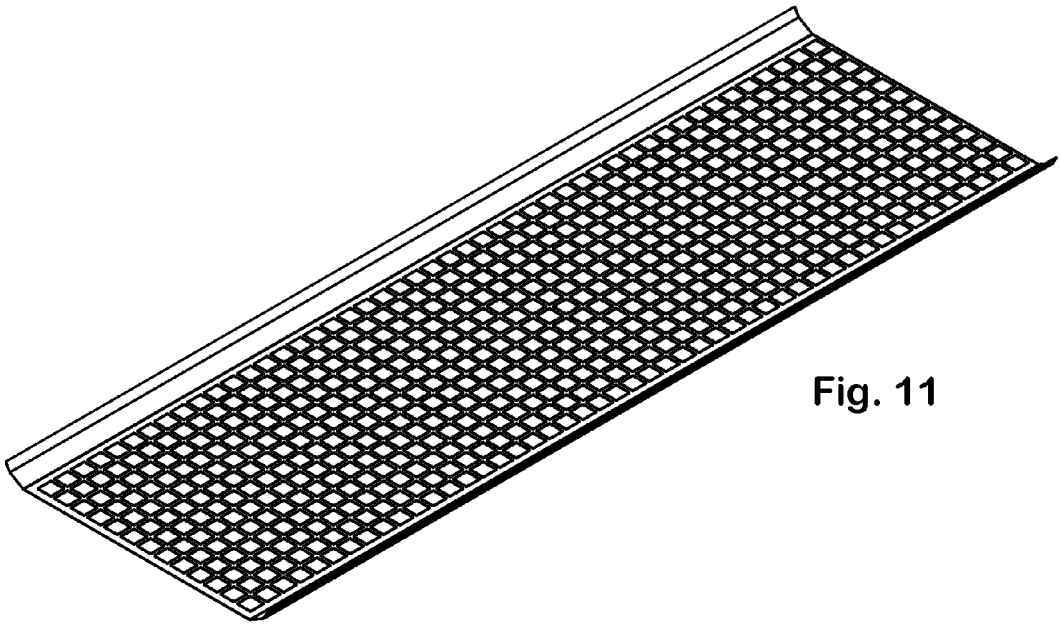
FIGS. 11 and 12 show alternative forms of a perforated metal reinforcing panel.
Figure 12:
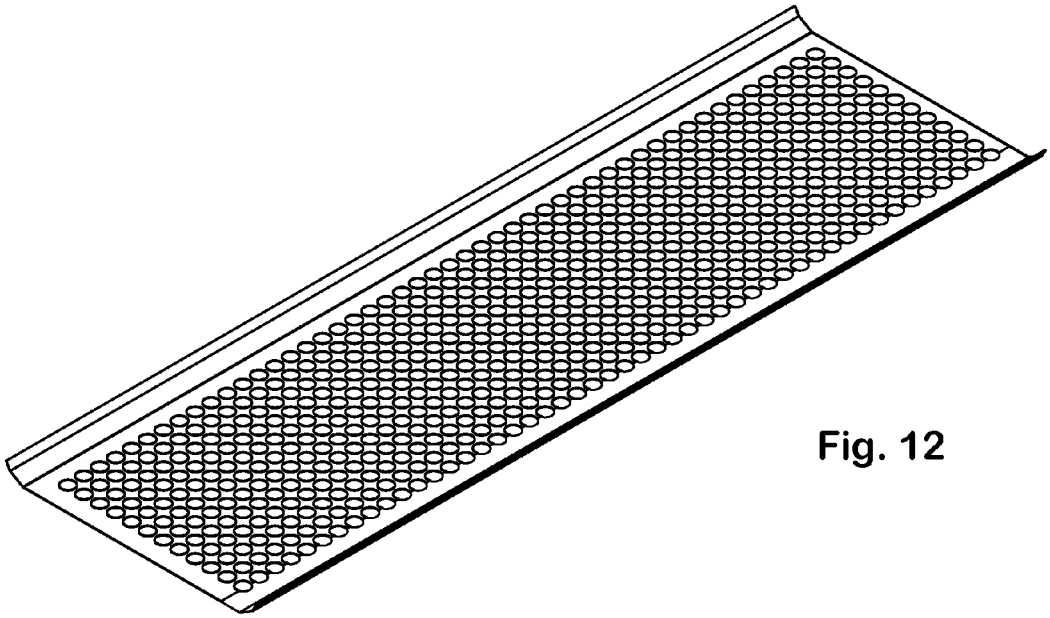

The reinforcing panel 105 has openings or perforations 120 that allow light from the light-transmitting panel 110 to pass through. The perforations, examples of which are seen in FIGS. 11 and 12, can vary in shape, size and configuration, as long as design strength criteria are met. The perforations preferably take up at least 50% of the surface area of the panel, so that the panel transmits at least 50% of the light falling upon it.

The light-transmitting panel 110 is designed to have substantially the same cross-sectional shape as the adjoining roof panels R, which may for example be MR-24® roof panels, made by Butler Manufacturing Co. Since the light-transmitting panel assembly 100 is a geometric substitute for a metal roof panel, the light panels can be placed anywhere on the roof.

The light-transmitting panel 110 may be constructed of a glass fiber reinforced polyester panel, such as the LitePanl® made by Butler Manufacturing Co. Preferably, however, the light-transmitting panel is constructed of polycarbonate, acrylic plexiglass or other polymeric material which has good clarity and provides impact resistance. Such materials have a greater light transmission than glass-reinforced plastic. With substantially transparent materials, the overall light transmission of the assembly, even accounting for the light blocked by the reinforcing panel, is as good or better than current translucent panels.

Nesting the light-transmitting panel with the reinforcing panel promotes flushness that discourages dirt from collecting and insects from nesting. Close contact between the light-transmitting panel and the reinforcing panel also supports the light-transmitting panel during even the slightest deflections, thereby preventing breakage that might otherwise occur.

The side corrugation 115 facilitates installing the light-transmitting panel 110, with or without a reinforcing panel 105, in a seamed roof. In the Butler Manufacturing Co. MR-24® and other similar roofing systems, the metal panels making up a roof have pre-formed edge flanges designed to interfit with complementary flanges on neighboring panels. The flanges are fit together and then are joined by crimping to form a water-tight, vapor-retarding seam.

The perforated reinforcing panel is preferably constructed of an alloy which is stronger than the neighboring roof panels. Strong materials are generally less ductile, so conventional crimping could cause the material to fail. To avoid material failures, yet provide substantially the same properties as the other seams formed in roof, the side corrugation 115 is made of a more ductile metal, and is attached to the light-transmitting panel 110 with rivets 125 or other suitable fasteners. The side corrugation provides a crimpable flange portion 130 that can safely be joined by seaming to adjacent roof panels.

The rivets 125 firmly interconnect the side corrugation 115, the reinforcing panel 105 and the light-transmitting panel 110. Preferably, mastic (not shown) is placed between the panels at the edges so that, when the side corrugation is seamed with adjacent roof panels, the safety reinforced light transmitting panel assembly provides a water-tight seal consistent with the rest of the roof.

As shown in FIG. 4, trim flashing "F" is installed across the purlins below the edges of the panels, to retain the insulation "I" and conceal it from view, thus providing a finished appearance.

In a second embodiment of the invention, illustrated in FIGS. 5 and 6, the roof panel assembly 200 includes a reinforcing panel 205 nested below a light-transmitting panel 210. In this embodiment, however, there is an additional transparent polymeric panel 220 which has a trough shape so that a substantial volume of air is trapped between the upper and lower panels 210,220.

FIG. 7 shows a third embodiment, in which the reinforcing panel 305 has ribs 340,345 which act as substitutes for the trim flashing F in confining and concealing the insulation. The adjacent ribs 340,345 together define a channel which reinforces the panel against lengthwise bending, making it strong enough to withstand reasonably expected or prescribed loads and impacts throughout the prescribed temperature range. The inner rib 340 confines the edge of the insulation "I" to provide a pleasing look. The outer rib 345 bites into or compresses the insulation to keep it in place. This compression also discourages moisture from entering and degrading the insulation. If desired, an adhesive (not shown) may be used to connect the insulation facing to the rib 340.

A fourth embodiment of the invention is shown in FIGS. 9 and 10. Here, a second light-transmitting panel 460 is placed between the transparent panel 410 and the reinforcing panel 405. The second light-transmitting panel 460 is constructed of any substantially trans-parent material, possibly the same material as the light-transmitting panel 410. In FIG. 10, the lower panel 460 is shown resting on the reinforcing panel 405, but other arrangements are possible. The plural transparent panels capture a pocket of dead air, insulating the building interior from exterior temperatures. The pocket also reduces condensation and deposits that would otherwise form following condensation on the light-transmitting panel, thus maintaining good light transmission.

While the invention is described in context with Butler Manufacturing Co. products, for which it may be best suited, the invention is adaptable for use with other metal roof panels and systems.

Inasmuch as the invention is subject to many variations and modifications, it is intended that the foregoing description and the drawings should be regarded as only examples of the invention defined by the following claims.

I claim:

1. A roof panel assembly comprising:

a first substantially transparent panel having a substantially flat middle and upwardly sloped lateral edges;

the upwardly sloped lateral edges being sealingly fixed on each side between two metal corrugations, each of said upwardly sloped lateral edges being received into slots created into interior edges of opposed sloped metal faces between opposing corrugations such that the first substantially transparent panel is made to be substantially flush with surrounding roof structures; and a discontinuous metal reinforcing panel underneath the first substantially transparent panel, said reinforcing panel having a mechanical strength substantially greater than that of said first panel and having a middle portion which is substantially flat and substantially parallel with the substantially flat middle of the first transparent panel.

2. The roof panel assembly of claim 1 wherein the corrugations are made of a crimpable ductile metal, the corrugations thus enabling said reinforcing panel and said first substantially transparent panel to be crimped into the roof along with a plurality of similarly shaped nontransparent metal panels.

3. The roof panel assembly of claim 1, wherein said reinforcing panel has two pairs of upwardly directed parallel ribs configured to secure an edge of a layer of insulation between the ribs and terminating the layer before it interferes with the light transmitting properties of the transparent panel.

4. The roof panel assembly of claim 1, further comprising a pair of trim flashing pieces securing respective edges of insulation between the trim flashing and the reinforcing panel.

5. The roof panel assembly of claim 1, wherein said discontinuous reinforcing metal panel is made of a metal which is less rigid than the crimpable ductile metal used to comprise the corrugations, the reinforcing metal panel being perforated in such a way that it transmits at least 50% of light falling upon it.

6. The roof panel assembly of claim 1 wherein the reinforcing panel has first and second ends, a substantially flat middle, and upwardly directed lateral edges such that said reinforcing panel conforms to the shape of the first transparent panel, the first transparent panel being nested within said reinforcing panel such that said lateral edges of said first light transmitting panel and said lateral edges of said reinforcing panel are superimposed and sealingly fastened into roof structures between opposing corrugations in the roof when the opposing corrugations are seamed.

7. The roof panel assembly of claim 1 wherein the reinforcing panel has first and second ends, a substantially flat middle, and upwardly directed lateral edges such that said reinforcing panel conforms to the shape of the first transparent panel, the assembly further comprising:

a second light transmitting panel in a substantially parallel plane to and in a spaced relation to the flat portions of the first light transmitting and reinforcing panels and creates a sealed air pocket between.

8. The roof panel assembly of claim 1 wherein said reinforcing panel has a portion that runs substantially parallel to and spaced away from said flat middle of said first light transmitting panel, said reinforcing panel having a second light transmitting panel resting on top of it covering a group of apertures through said reinforcing panel.

9. The roof panel assembly of claim 8 wherein the first light transmitting panel, reinforcing panel, and second light transmitting panel together form a sealed air pocket.

10. A safety window for a roof, the window comprising:

a first longitudinally extending light transmitting panel having first and second ends, a substantially flat middle, and upwardly directed lateral edges;

a longitudinally extending reinforcing panel having first and second ends, a substantially flat middle, and upwardly directed lateral edges; and the first light transmitting panel being nested within said reinforcing panel such that said lateral edges of said first light transmitting panel and said lateral edges of said reinforcing panel are superimposed and sealingly fastened into roof structures between opposing corrugations in the roof when the opposing corrugations are seamed.

11. The safety window of claim 10 comprising:

a second light transmitting panel in a substantially parallel plane to and in a spaced relation to the first light transmitting window to create a sealed air pocket.

* * * * *